US012044495B2

(12) United States Patent
Johansen et al.

(10) Patent No.: US 12,044,495 B2
(45) Date of Patent: Jul. 23, 2024

(54) COAXIAL GAS FLOW SILENCER FOR A FIREARM

(71) Applicant: A-TEC HOLDING AS, Son (NO)

(72) Inventors: Anders Eckhoff Johansen, Son (NO); Hallvard Wintherseth, Saltnes (NO)

(73) Assignee: A-TEc Holding AS, Son (NO)

( * ) Notice: Subject to any disclaimer, the term of this patent is extended or adjusted under 35 U.S.C. 154(b) by 227 days.

(21) Appl. No.: 17/438,470

(22) PCT Filed: Mar. 19, 2020

(86) PCT No.: PCT/EP2020/057629
§ 371 (c)(1),
(2) Date: Sep. 13, 2021

(87) PCT Pub. No.: WO2020/193369
PCT Pub. Date: Oct. 1, 2020

(65) Prior Publication Data

US 2022/0155034 A1 May 19, 2022

(30) Foreign Application Priority Data

Mar. 22, 2019 (NO) ..... 20190394

(51) Int. Cl.
*F41A 21/30* (2006.01)
*F41A 21/28* (2006.01)
*F41A 21/32* (2006.01)

(52) U.S. Cl.
CPC ..... *F41A 21/30* (2013.01); *F41A 21/28* (2013.01); *F41A 21/325* (2013.01)

(58) Field of Classification Search
CPC ..... F41A 21/30; F41A 21/28; F41A 21/325; F41A 21/32
(Continued)

(56) References Cited

U.S. PATENT DOCUMENTS 1,000,702 A 8/1911 Thurler
1,207,264 A * 12/1916 Bailey ..... F41A 21/30 89/14.4
(Continued)

FOREIGN PATENT DOCUMENTS

EP 2235594 5/2011
EP 3489613 5/2019
(Continued)

OTHER PUBLICATIONS

ISRWO in PCT/EP2020/057629 dated Jun. 26, 2020, cited inter alia as statement of relevance for any non-English references cited therein.

*Primary Examiner* — Michael D David
(74) *Attorney, Agent, or Firm* — Christian D. Abel

(57) ABSTRACT

A coaxial gas flow silencer for a firearm having an outer sleeve or cylinder forming an outer surface of the silencer and an inner sleeve or cylinder forming an inner surface of the silencer. Within the inner cylinder is a core portion having a bore through which a projectile will travel, and one or more expansion chambers for expanding exhaust gas from the firing of a cartridge. The space between the inner an outer cylinders forms a first passage for a first portion of exhaust gas, exiting the silencer through a number of radially arranged openings at a periphery of an end plate at the muzzle end of the silencer. The inner cylinder and core portion form a second passage for a second portion of exhaust gas exiting via the bore through a central opening in the face plate.

12 Claims, 4 Drawing Sheets

Figure 1:
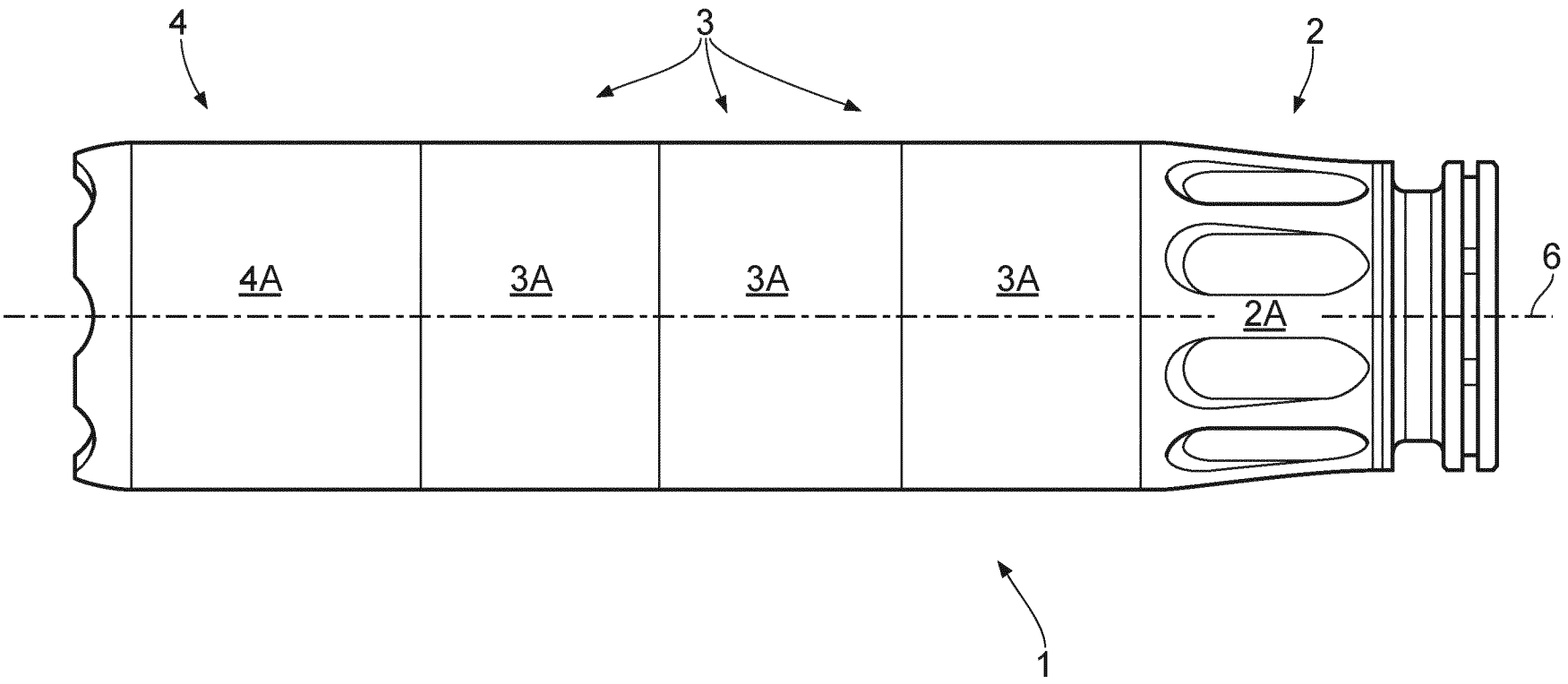

(58) Field of Classification Search
USPC ..... 89/14.3, 14.4
See application file for complete search history.

(56) References Cited

U.S. PATENT DOCUMENTS

| | | | | |
|---|---|---|---|---|
| 2,449,571 | A * | 9/1948 | Walker | F41A 21/30 89/14.4 |
| 3,667,570 | A * | 6/1972 | WerBell, III | F41A 21/30 89/14.4 |
| 3,710,679 | A * | 1/1973 | Werbell, III | F41A 21/30 89/14.4 |
| 5,679,916 | A | 10/1997 | Weichert | |
| 6,575,074 | B1 | 6/2003 | Gaddini | |
| 8,286,750 | B1 | 10/2012 | Oliver | |
| 8,459,405 | B1 * | 6/2013 | Dueck | F41A 21/34 89/14.4 |
| 8,459,504 | B2 | 6/2013 | Dueck | |
| 8,506,941 | B2 | 8/2013 | Oliver | |
| 8,826,793 | B2 | 9/2014 | Oliver | |
| 8,939,057 | B1 * | 1/2015 | Edsall | F41A 21/30 89/14.05 |
| 9,410,761 | B2 * | 8/2016 | Morris | F41A 21/30 |
| 9,500,427 | B1 | 11/2016 | Larue | |
| 9,506,710 | B2 * | 11/2016 | Smith | F41A 21/30 |
| 9,513,078 | B1 * | 12/2016 | Fulton | F41A 21/325 |
| 10,107,581 | B2 * | 10/2018 | Garst | F41A 21/30 |
| 10,119,779 | B1 | 11/2018 | Miele | |
| 10,591,238 | B1 * | 3/2020 | Bader | F41A 21/30 |
| 10,690,433 | B2 | 6/2020 | Oliver | |
| 10,890,403 | B2 | 1/2021 | Petersen | |
| 11,486,670 | B1 * | 11/2022 | Lovas | F41A 21/325 |
| 2002/0112602 | A1 | 8/2002 | Champion | |
| 2012/0180624 | A1 | 7/2012 | Troy | |
| 2013/0133976 | A1 * | 5/2013 | Johansen | F41A 21/325 181/223 |
| 2016/0018178 | A1 * | 1/2016 | Johansen | F41A 21/30 181/223 |
| 2016/0209152 | A1 * | 7/2016 | Dueck | F41A 21/30 |
| 2018/0202742 | A1 | 7/2018 | Brittingsham | |
| 2018/0283822 | A1 * | 10/2018 | Johansen | F41A 21/30 |
| 2018/0313626 | A1 | 11/2018 | Tomczak | |
| 2018/0356173 | A1 | 12/2018 | Lindsey | |
| 2019/0063859 | A1 * | 2/2019 | Gilpin | F41A 21/30 |
| 2019/0226788 | A1 * | 7/2019 | Johansen | F41A 21/325 |
| 2020/0284542 | A1 * | 9/2020 | Winterseth | F41A 21/325 |

FOREIGN PATENT DOCUMENTS

| | | |
|---|---|---|
| RU | 2366884 | 10/2008 |
| RU | 2007115744 | 10/2008 |
| WO | 2016/126227 | 8/2016 |
| WO | 2016126227 | 8/2016 |

* cited by examiner

DETAIL C
SCALE 2:1

DETAIL D
SCALE 2:1

DETAIL E
SCALE 2:1

SECTION F-F
SCALE 1:1

SECTION B-B
SCALE 1:1

COAXIAL GAS FLOW SILENCER FOR A FIREARM

The present invention relates to a silencer for a firearm, in particular an automatic or semi-automatic firearm, where the silencer comprises at a muzzle portion and an attachment portion, at least one module being arranged between said portions, where the silencer is intended to be releasably connected to a barrel of the firearm or to attachment element(s) arranged on the barrel of the firearm.

Silencers for a firearm are well known in the prior art. The advantages of reducing the muzzle blast, noise and flash signature of a discharging firearm are well known.

The need to regulate the flow of gas between the barrel and operating system of a firearm has been a concern since the invention of autoloading firearms. Gas is generated during the combustion of gun powder present in the cartridges used in firearms. This gas expands violently to push the bullet out of the firearm's barrel. These expanding gases are also utilized as a means to operate the action of the host firearm. In modern firearms, the preferred method of facilitating the function of an autoloading weapon is as follows. A hole, or gas port, is placed through the barrel, generally on the top. Location of the gas port varies between operating systems and gas port size is chosen to allow a broad range of ammunition to be utilized while guaranteeing the reliable function of the host firearm. Unfortunately, due to varying lengths of barrels, ammunition variance, and other factors, it is very difficult to choose a gas port size which universally works under all conditions. A popular way of compensating for these problems is to incorporate an adjustable gas block into the operating system.

Traditionally, adjustable gas blocks have been used with autoloading rifles as a means to collect, restrict, and direct the flow of gas from the barrel into the gas operating system. By controlling the amount of gas directed into the operating system, reliable operation of the host firearm is ensured while also ensuring that recoiling parts are not actuated with undue force resulting in malfunctions or premature wear and breakage of parts.

In response to military request and an increased interest in both civilian and police markets, recent firearm designs have incorporated adjustable gas blocks designed to be used in conjunction with noise suppressors or silencers. Noise suppressors provide a means to redirect and expand the gases generated from the discharge of a firearm so that the resulting flash and sound generated by the firearm is minimized or eliminated. As a result, back pressure is generated, forcing more gas into the firearm's operating system. This extra gas, or back pressure, increases the firing rate of a weapon when operating at full auto, fouls the weapon leading to premature malfunction, can cause a variety of feeding and extraction problems, and causes premature wear on the reciprocating parts of the operating system. As a result, regulating the flow of gas into a firearm's operating system and optimizing that flow for use with and without a noise suppressor has become a primary purpose of modern adjustable gas blocks.

U.S. Pat. No. 8,857,306 B1 relates to a firearm suppressor, where an inertial damping apparatus in communication with a dynamic suppression mechanism for a firearm. The apparatus is in communication with both a muzzle of a projectile release device and with the suppressor. The apparatus dynamically extends between different states of compression. The apparatus is comprised of a body and an axial sleeve, with the sleeve functioning to guide movement of the body and to hold a first end of axially variable material in position when subject to compression.

US 2014/158459 A1 relates to a firearm sound suppressor, where the suppressor can be selectively oriented relative to the firearm. The suppressor has an elongate body, a piston assembly and a cam assembly. A piston of the piston assembly can be fixedly attached to the barrel of a firearm. An indexing ring is radially fixed relative to the piston. The cam lever is selectively movable between a second position, in which the indexing ring is fixed relative to the elongate body, and a first position, in which the indexing ring can rotate relative to the elongate body.

US 2013/263490 A1 relates to an interchangeable, modular firearm muzzle mountable system, where the system includes a first firearm muzzle mountable device and a second firearm muzzle mountable device. Each device can have an inlet end coupling feature proximate to an inlet end of a central chamber and an outlet end coupling feature proximate to an outlet of the central chamber. The central chamber can be oriented along a central axis within an outer shell and the inlet and the outlet can be configured to allow a projectile from a firearm to pass along the central axis. The inlet end coupling feature of the first device can be removably couplable with a muzzle end of a firearm and the inlet end coupling feature of the second device can be removably couplable with the outlet end coupling feature of the first device beyond the muzzle end of the firearm.

US 2018/356173 A relates to modular gun silencer, where the gun silencer includes an outer tube and a plurality of chamber separators suspended through a tensile force within a bore of the outer tube and defining chambers between each pair of chamber separators in the silencer. An outer edge of the chamber separators is spaced apart from an inner surface of the tube to allow gas equalization between the chambers. A plurality of tube portions separates the chamber separators from each other and from the proximal and distal ends of the silencer assembly. The tube portions define a continuous center tube suspended in tension within the outer tube and through which the projectile travels. The tube portions can have angled openings through which gas discharge exits into the chambers. Rotatable sleeves can be disposed over the tube portions to further disrupt gas flow and dissipate heat and sound.

US 2018/202742 A relates to a modular suppressor kit, where the suppressor kit includes a modular suppressor and suppressor tool. The modular suppressor includes a barrel attachment portion that has a central passage. The barrel attachment portion is configured to attach to a firearm barrel. The modular suppressor includes a cap portion that has a central passage. The modular suppressor includes a body portion that has an internal baffle structure and an expansion chamber. The body portion is attachable to, and separable from, the barrel attachment portion and the cap portion. The body portion defines a central passage that is alignable with the central passage of the barrel attachment portion and the central passage of the cap portion. The suppressor tool has an engagement feature for engaging with at least one of the barrel attachment portion, cap portion, and body portion.

The object of the present invention is to provide a silencer that controls the flow direction of the exhaust gases, which is modular, and comprises few parts and at the same time is light in weight.

The present invention seeks to provide an alternative silencer, which offers satisfactory diversion of the exhaust gases' direction of flow while at the same time being modular and consisting of a small number of parts.

This object is obtained according to the invention by the features disclosed in the following independent claim, with additional features of the invention set forth in the dependent claims and the description below.

The present invention relates to a silencer for a firearm, where the silencer is designed to be detachably connectable to one or more attachment elements arranged on a barrel of the firearm, or to the barrel of the firearm.

According to the present invention it is provided a silencer for firearms, where the silencer comprises an attachment part for releasable connection to a barrel of a firearm and a muzzle part, where at least one intermediate module element is arranged between the attachment part and the muzzle part, where the attachment part, the at least one intermediate module element and the muzzle part, when connected to each other in appropriate ways, will form the silencer. Each of the attachment part, the intermediate module element and the muzzle part comprises an outer sleeve portion, where the outer sleeve portions, when the silencer is assembled, will form an outer surface of the silencer. Each of the intermediate module elements comprises further an inner sleeve portion and a core portion, where the inner sleeve portion form a part of an inner surface of the silencer and where the core portion comprises a throughgoing bore. Furthermore, the outer and inner sleeve portion is connected through a radial part, where the radial part is provided with a plurality of axial throughgoing openings around it's periphery. When the silencer is assembled, the outer sleeve portion and inner sleeve portion of the intermediate module element(s) form a volume defining a first passage for exhaust gases, and the inner sleeve portion and the core portion form a volume defining a second passage for exhaust gases.

The silencer according to the present invention may comprise one or a plurality of intermediate module elements, for instance two, three or more intermediate module elements, where the different parts and elements in appropriate ways are connected to each other to form the silencer.

Through the above arrangement of the silencer, the exhaust gases after firing of a cartridge or shell from the firearm, will enter into a cavity formed in the attachment part of the silencer, where the exhaust gases are expanded, whereafter a part of the expanded exhaust gases will be forced and compressed through the axial throughgoing openings provided around the periphery of the radial part of the attachment part and guided into a cavity formed in the subsequent intermediate module element. At the same time, a part of the expanded exhaust gases will be forced and compressed through the throughgoing bore of the core portion and into a cavity formed between the core portion and the inner sleeve portion of the attachment part. A rest part of the expanded exhaust gas will be forced back and out of the cavity formed in the attachment part, where this rest part of the expanded exhaust gases will be utilized as means to operate the action of the host firearm.

The process will be repeated in the subsequent intermediate module element, and in each following intermediate module element, where the exhaust gases once again are expanded in the cavity formed in this intermediate module element and thereafter forced and compressed through the throughgoing openings provided around the periphery of the radial part of the intermediate module element and thereafter guided into a cavity formed in the subsequent muzzle part, if the silencer, for example comprises two intermediate module elements, where the exhaust gases will escape out from the muzzle part of the silencer through the throughgoing openings provided in the muzzle part. At the same time, the part of the exhaust gases that is guided into the cavity formed between the core portion and the inner sleeve portion of the intermediate module element(s), will escape out from the muzzle part through the throughgoing bore of the core element of the intermediate module element(s).

This expansion and compression process of the exhaust gases will be repeated as many times as there are intermediate modul elements in the silencer.

In one aspect of the invention each of the attachment part and the muzzle part may comprise a radial part provided with a plurality of axial throughgoing openings around a periphery of the radial part, and a center opening. The axial throughgoing openings may be arranged with a same distance between them, but it should be understood that the axial throughgoing openings could be arranged with different distance between then, at least for some of the axial throughgoing openings.

The muzzle part may, on an inside of the outer sleeve portion and on an opposite side of the radial part, be provided with a threaded area or portion. Similarly, the attachment part may, on an inside of the outer sleeve and on an opposite side of the radial part, be provided with a threaded area or portion.

In one aspect of the invention the inner sleeve portion and the core portion of each of the intermediate module elements may extend outward in one direction from the radial part, and the outer sleeve extends outward in an opposite direction from the radial part. Through this arrangement, when for instance an attachment part is connected or assembled to a subsequent following intermediate module element, the outer sleeve portion of the attachment part will extend over the inner sleeve portion of the subsequent following intermediate module element. Similarly, the inner sleeve portion and the core portion of this intermediate module element will extend into the outer sleeve of a subsequent following intermediate module element or a subsequent following muzzle part.

As the attachment part is to be connected to the subsequent following intermediate module element, and this intermediate module element is to be connected to a subsequent following intermediate module element or alternatively to the muzzle part, each of the attachment part and the intermediate module element(s) is/are, on an inside of the outer sleeve portion provided with an internal or inner threaded portion, while an outside of the radial part of each intermediate module element is provided with an external or outer threaded portion.

The internal threaded area or portion of the attachment part will allow the silencer to be releasably connected to a barrel of a firearm, or to attachment element(s) arranged on the barrel of the firearm. The barrel of the firearm or the attachment element(s) are then provided with an external or outer threaded portion. Similarly, the external threaded portion of the attachment part and the internal threaded portion of an intermediate module element will allow a connection between the attachment part and the intermediate module element, while the external threaded portion of the intermediate module element and the internal threaded portion of the muzzle part or alternatively a subsequent following intermediate module element will allow a connection between the intermediate module element and the muzzle part, or the connection between two adjacent or subsequent intermediate module elements.

In one aspect of the present invention, each core portion of the intermediate module elements may be, around a periphery of the core portion, provided with a plurality of radial throughgoing openings, where the plurality of radial throughgoing openings form a connection with the throughgoing bore of the core portion. It should be understood that the number of radial throughgoing openings could vary from one to eight or even more, this depending on ammunition variance (i.e. caliber), and other factors, such as charge (i.e. gun powder present in the cartridges) or the like.

In one aspect the plurality of radial throughgoing openings provided in the intermediate module elements may be provided to form an angle with the throughgoing bore of the core portion. The radial throughgoing openings may have a circular, oval, polygonal or square form.

In one aspect of the present invention a diameter of the inner sleeve portions may be larger than a diameter of the core portion.

Further objects, structural embodiments and advantages of the present invention will be seen clearly from the following detailed description, the attached drawings and the claims below.

Figure 2:
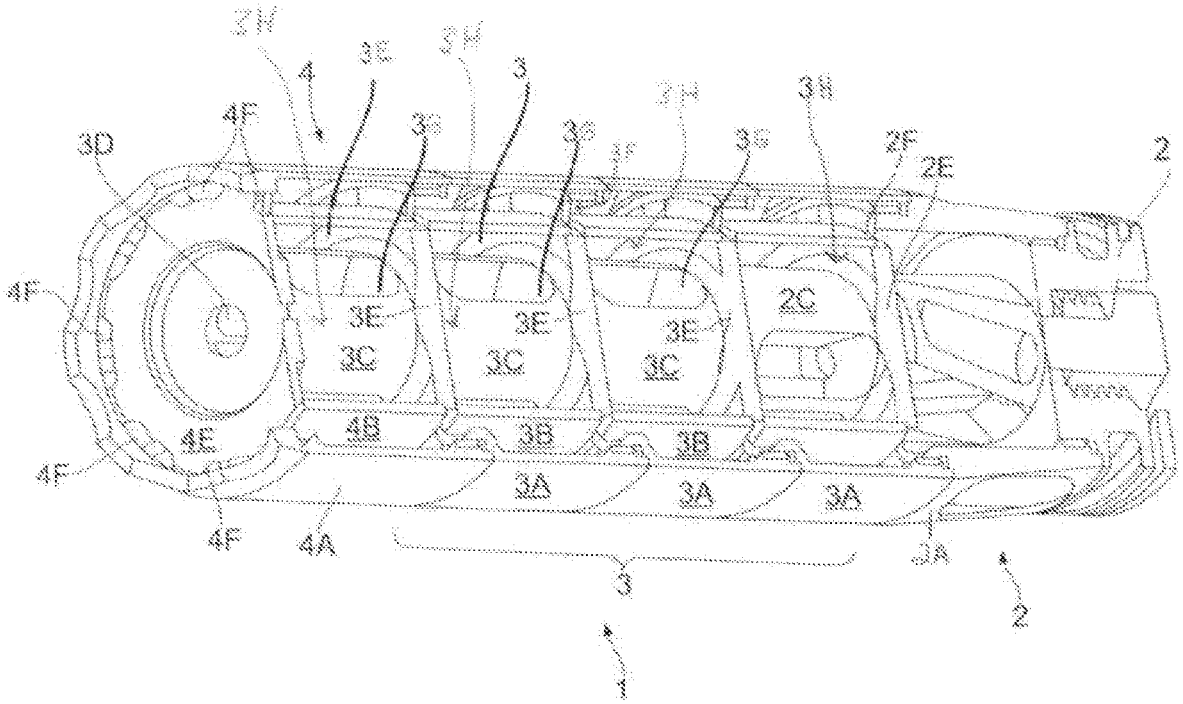
Figure 3D:
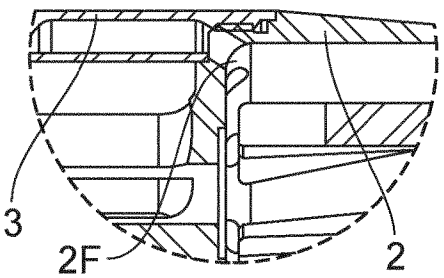
Figure 3C:
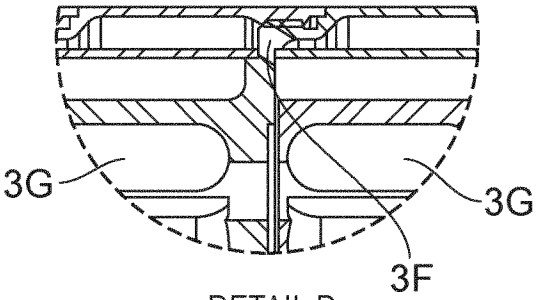
Figure 3B:
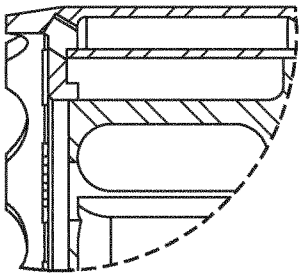
Figure 3E:
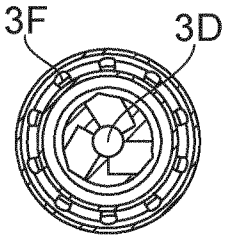
Figure 3A:
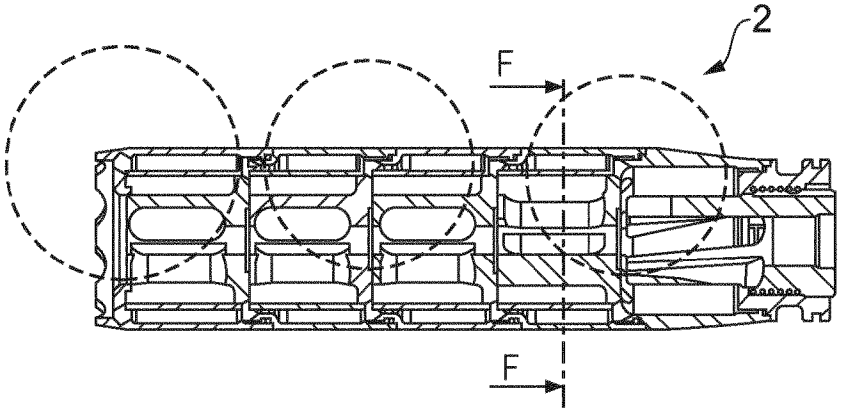
Figure 3A:
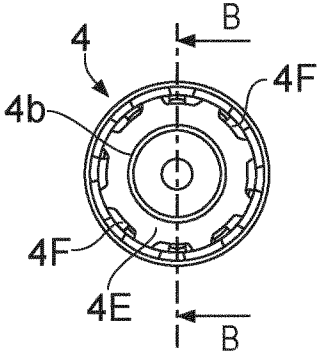
Figure 3A:
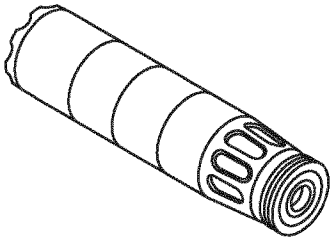
Figure 4:
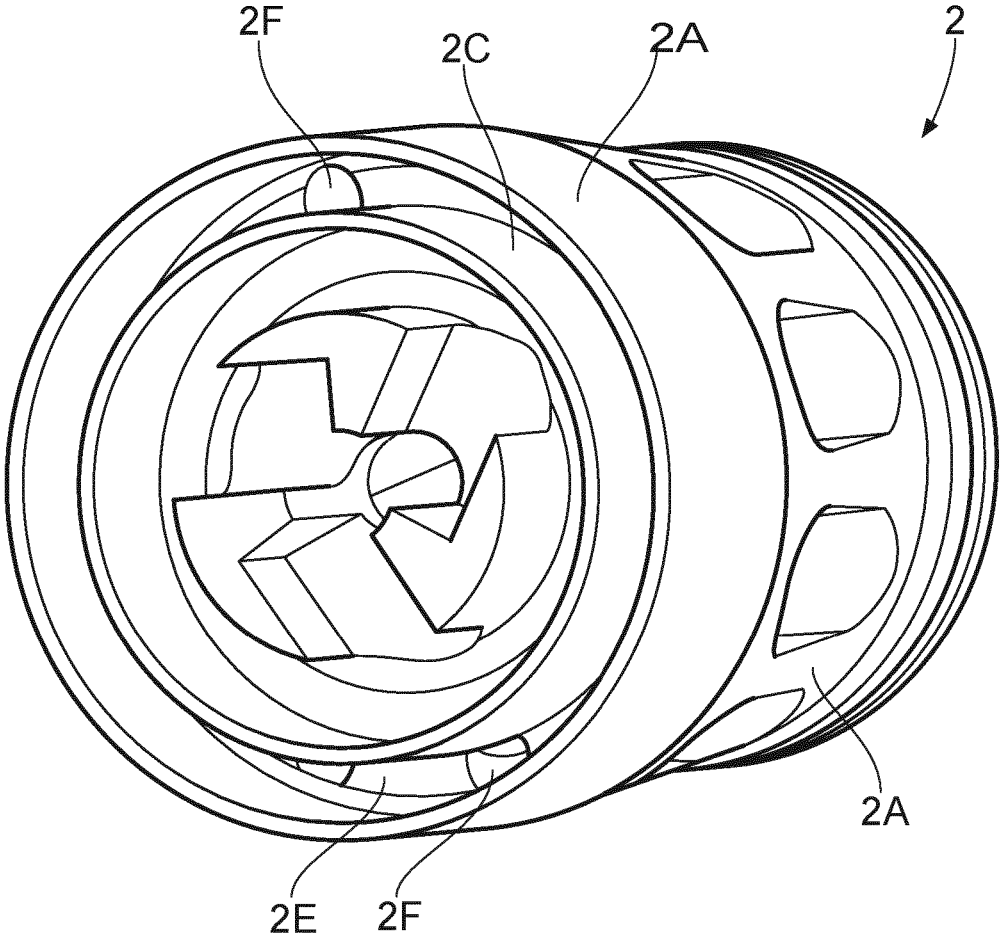

The invention will now be explained through several not limiting embodiments with reference to the accompanying figures wherein;

FIG. 1 shows an assembled silencer according to the present invention viewed from the side, FIG. 2 shows a cross-section along the silencer according to FIG. 1, the cross-section being offset a center plane of the silencer, FIGS. 3A-3E show the silencer according to FIG. 1 in an assembled state (FIG. 3A), in greater detail (FIGS. 3B-3D) and a cross-section along line F-F in FIG. 3A (FIG. 3E), and FIG. 4 shows an attachment part of the silencer according to the present invention, seen in a perspective view.

FIG. 1 shows a silencer 1 for firearms according to the present invention in an assembled state, where the silencer 1 comprises an attachment part 2, three intermediate module elements 3 and a muzzle part 4 that are connected to each other in appropriate ways. With such a module-based arrangement of the silencer 1, the length of the silencer 1 can be adjusted and thereby the effect thereof.

The different parts 2, 3, 4 are arranged in alignment with each other and have a common center axis 6 extending over a length of the silencer 1. The attachment part 2 can be releasably connected to a barrel of a firearm (not shown) or to attachment element(s) (not shown) arranged on the barrel of the firearm.

Although the silencer 1 is shown to comprise three intermediate module elements 3, it should be understood that the silencer 1 according to the present invention could comprise fewer intermediate module elements 3, for instance one or two, or more intermediate module elements 3, for instance four or more.

The firearm may, for example, be an automatic or semi-automatic rifle or the like.

According to the present invention, each of the attachment part 2, each intermediate module element 3 and muzzle part 4, see also FIG. 2, comprises an outer sleeve portion 2A, 3A, 4A, each of the outer sleeve portions 2A, 3A, 4A forming a part of an outer surface of the silencer 1, and together form the outer surface of the silencer 1 when the silencer 1 is assembled.

Each of the intermediate module element 3 comprises further an inner sleeve portion 3B and a core portion 3C, where each of the inner sleeve portions 3B forms a part of an inner surface of the silencer 1 when the silencer 1 is assembled.

A throughgoing bore 3D is formed in each of the core portions 3C of the intermediate module element(s) 3.

Furthermore, each of the attachment part 2 and the muzzle part 4 comprise a radial part 2E, 4E provided with a plurality of axial throughgoing openings 2F, 4F around a periphery of the radial part 2E, 4E and a center opening. The plurality of axial throughgoing openings 2F, 4F may be arranged with a same distance between them, but it should be understood that the axial throughgoing openings 2F, 4F could be arranged with different distance between then, at least for some of the axial throughgoing openings 2F, 4F.

The outer sleeve portion 3A and the inner sleeve portion 3B of each intermediate module element 3 are connected to each other through a radial part 3E.

Furthermore, a plurality of axial throughgoing openings 2F are provided around a periphery of the radial part of the attachment part 2, and a plurality of axial throughgoing openings 3F are provided around a periphery of the radial part 3E of each intermediate module element 3.

Exhaust gases can then through the above arrangement of the respective outer sleeve portions 2A, 3A, 4A of the attachment part 2, the intermediate module element(s) 3 and the muzzle part 4 together with the inner sleeve portions 3B of the intermediate module element(s) and the radial parts 2E, 3E, 4E of the attachment part 2, the intermediate module element(s) 3 and the muzzle part 4 escape through the plurality of axial throughgoing openings 2F, 3F, 4F from one part or element to a subsequent part or element, for instance from the attachment part 2 and to a subsequent following intermediate module element 3, from the intermediate module element 3 and to the subsequent following intermediate module element 3 or from an intermediate module element 3 to a subsequent following muzzle part 4, whereafter the exhaust gasses can escape out from the silencer 1 through the axial throughgoing openings 4F of the muzzle part 4.

When the silencer 1 is assembled, the outer sleeve portions 2A, 3A, 4A of the attachment part 2, the intermediate module element(s) 3 and the muzzle part 4, with the inner sleeve portions 3B of the intermediate module element(s) 3 will form a volume or cavity defining a first passage for exhaust gases, and the inner sleeve portions 3B and the core portions 3C of the intermediate module element(s) 3 will form a volume or cavity defining a second passage for exhaust gases through the silencer 1.

Through the above arrangement of the silencer 1, the exhaust gases after firing of a cartridge or shell from a firearm (not shown), will enter into a volume or cavity formed in the attachment part 2 of the silencer 1, where the exhaust gases are expanded in this volume or cavity, whereafter a part of the expanded exhaust gases will be forced and compressed through the axial throughgoing openings 2F provided around the periphery of the radial part 2E of the attachment part 2 and thereafter guided into a volume or cavity formed in the subsequent following intermediate module element 3. At the same time, a part of the expanded exhaust gases will be forced and compressed through the center of the attachment part 2 and thereafter guided into the throughgoing bore 3D of the subsequent following intermediate module element 3. A rest part of the expanded exhaust gas will be forced back and out of the volume or cavity formed in the attachment part 2, where this rest part of the expanded exhaust gases will be utilized as means to operate the action of the host firearm.

The process will be repeated in the subsequent following intermediate module element 3, where the exhaust gases once again are expanded in the volume or cavity formed in this intermediate module element 3 and thereafter forced and compressed through the axial throughgoing openings 3F provided around the periphery of the radial part 3E of this intermediate module element 3 and guided into a volume or cavity formed in the subsequent following muzzle part 4, if the silencer 1, for example comprises only one intermediate module element 3, where the exhaust gases will escape out from the muzzle part 4 of the silencer 1 through the axial throughgoing openings 4F provided in the muzzle part 4. At the same time, the part of the exhaust gases that is guided into the cavity 3H formed between the core portion 3C and the inner sleeve portion 3B of this intermediate module element 3, will escape out from the muzzle part 4 through the throughgoing bore 3D of the core portion 3C of this intermediate module element 3.

If the silencer 1 comprises two or more intermediate module elements 3, then the exhaust gases will be expanded once again in each intermediate module element 3 as described above and thereafter forced and compressed through the axial throughgoing openings 3F provided around the periphery of the radial part 3E of this intermediate module element 3 and guided into a volume or cavity formed in the subsequent following muzzle part 4. At the same time, the part of the exhaust gases that are guided into the cavity 3H formed between the core portion 3C and the inner sleeve portion 3B of this intermediate module element 3, will escape out from this intermediate module element 3 and into the subsequent following intermediate module element 3 and eventually out from the muzzle part 4 through the throughgoing bore 3D of the core portion 3C of the adjacent intermediate module element 3.

The respective inner sleeve portion 3B and the core portion 3C of each of the intermediate module elements 3 are extended outward in one direction from the radial part 3E, and the outer sleeve 3A extends outward in an opposite direction from the radial part 3E. Through this arrangement, when for instance an attachment part 2 is connected or assembled to a subsequent following intermediate module element 3, the outer sleeve portion 2A of the attachment part 2 will extend over the inner sleeve portion 3B of the subsequent following intermediate module element 3. Similarly, the inner sleeve portion 3B and the core portion 3C of this intermediate module element 3 will extend into the outer sleeve portion 3A of a subsequent following intermediate module element 3 or into a subsequent following muzzle part 4.

The attachment part 2 and the intermediate module element 3 are, on an inside of the outer sleeve 2A, 3A, provided with a threaded portion, while an outside of the radial parts 3E of the intermediate module elements 3 are provided with a threaded portion.

Furthermore, the core portion 3C of the intermediate module element 3, around a periphery of the core portion 3C, is provided with a plurality of radial throughgoing openings 3G, where the plurality of the radial throughgoing openings 3G form a connection with the throughgoing bore 3D of the intermediate module element 3 and cavity 3H.

The present invention has now been explained with reference to embodiments, but a person of skill in the art will understand that changes and modifications could be made in relation to these embodiments within the scope of the invention as defined in the following claims.

The invention claimed is:

1. A silencer for a firearm comprising a barrel attachment part at a proximal end of the silencer for connecting the silencer to a barrel of the firearm and a muzzle part at a distal end of the silencer, the silencer further comprising an outer sleeve portion forming a part of an outer surface of the silencer, and an inner sleeve portion having a core portion located within the inner sleeve portion, wherein a space between the core portion and the inner sleeve portion defines at least one expansion cavity for expanding exhaust gas from the firing of a cartridge, said core portion comprising a throughgoing bore arranged to receive and convey a projectile of the cartridge through and exiting the silencer, and at least one opening connecting the bore with the at least one expansion cavity, wherein, when the silencer is assembled, a space between said outer sleeve portion and inner sleeve portion forms a first volume defining a first passage for arranged to expel a first portion of exhaust gases from the muzzle part though a plurality of radial openings in an end plate of the muzzle part, the radial openings being in communication with the first passage, and wherein said inner sleeve portion and core portion with bore form a second volume defining a second passage arranged to expel a second portion of exhaust gases from the muzzle part via the bore through a central opening in the end plate.

2. A silencer according to claim 1, comprising at least one intermediate module element arranged between the barrel attachment part and the muzzle part, the at least one intermediate module element comprising a corresponding outer sleeve portion, inner sleeve portion, expansion cavity and core portion with bore, and wherein a radial connection part connects the inner sleeve portion to the outer sleeve portion, the radial connection part having at least one axial throughgoing opening arranged to permit the first portion of exhaust gases to traverse the radial connection part along the first passage.

3. A silencer according to claim 2, wherein each of the barrel attachment part, the muzzle part, and the at least one intermediate module element are provided with a threaded portion for interconnection therebetween, and wherein outer surfaces of the barrel attachment part, the muzzle part and the at least one intermediate module element together comprise the outer sleeve portion of the silencer.

4. A silencer according to claim 2, wherein the inner sleeve portion and the outer sleeve portion of the intermediate module element extend outward in one direction from the radial connection part, and the core portion extends outward in an opposite direction from the radial connection part.

5. A silencer according to one of claims 1-4, wherein the barrel attachment part is in fluid communication with both the first and second passages.

6. A silencer according to claim 2, wherein the at least one axial throughgoing opening of the radial connection part is angled over a material of the radial connection part.

7. A silencer according to claim 6, wherein the at least one radial throughgoing opening is arranged at an angle with the throughgoing bore.

8. A silencer according to claim 1 or 2, wherein a diameter of the inner sleeve is larger than a diameter of the core portion.

9. A silencer according to claim 1, wherein an outer sleeve portion of the barrel attachment part has a tapered form.

10. A silencer according to claim 1, wherein the the barrel attachment part comprises a radial connection part between an outer sleeve portion and an inner sleeve portion, the radial connection part having at least one axial through going opening in communication with the first passage, for transmittal of at least a part of the first portion of exhaust gases from the barrel attachment part to the first passage.

11. A silencer according to claim 1, wherein the plurality of radial openings of the end plate have a circular, oval, polygonal or square shape.

12. A silencer according to claim 1 or 2, wherein wherein the silencer is arranged to direct a third portion of exhaust gas to cycle the firing of the firearm.

* * * * *